US012018597B2

(12) United States Patent
Meeker et al.

(10) Patent No.: US 12,018,597 B2
(45) Date of Patent: Jun. 25, 2024

(54) REPLACEMENT TAPPET ASSEMBLY AND KIT

(71) Applicant: 1F Performance, Inc., Ormond Beach, FL (US)

(72) Inventors: Douglas Meeker, Deland, FL (US); Kevin Alley, Ormond Beach, FL (US)

(73) Assignee: 1F Performance, Inc, Ormond Beach, FL (US)

( * ) Notice: Subject to any disclaimer, the term of this patent is extended or adjusted under 35 U.S.C. 154(b) by 0 days.

(21) Appl. No.: 18/456,094

(22) Filed: Aug. 25, 2023

(65) Prior Publication Data

US 2024/0068384 A1 Feb. 29, 2024

Related U.S. Application Data

(60) Provisional application No. 63/373,483, filed on Aug. 25, 2022.

(51) Int. Cl.
*F01L 1/14* (2006.01)

(52) U.S. Cl.
CPC ..... *F01L 1/14* (2013.01); *F01L 1/146* (2013.01); *F01L 2307/00* (2020.05); *F01L 2800/17* (2013.01)

(58) Field of Classification Search
CPC ..... F01L 1/14; F01L 1/146; F01L 2307/00
USPC ..... 123/90.5, 90.61
See application file for complete search history.

(56) References Cited

FOREIGN PATENT DOCUMENTS

CN 1738963 A * 2/2006 ..... F01L 1/146

* cited by examiner

*Primary Examiner* — Jorge L Leon, Jr.
(74) *Attorney, Agent, or Firm* — Daniel C. Pierron; Widerman Malek, PL

(57) ABSTRACT

An anti-rotation bracket for an internal combustion engine, including a peripheral wall having formed therein four outer apertures formed proximate to four corners of the bracket and a groove formed in a lower surface of the bracket, the groove forming a contiguous depression around the lower surface of the bracket and passing between each outer bolt aperture and a center of the bracket. The bracket further includes two tappet structures comprising tappet apertures, the tappet structures being centered inward from the peripheral wall, and an inner aperture positioned inward from the peripheral wall.

14 Claims, 3 Drawing Sheets

REPLACEMENT TAPPET ASSEMBLY AND KIT

RELATED APPLICATIONS

This application claims priority under 35 U.S.C. § 119(e) of U.S. Provisional Patent Application Ser. No. 63/373,483 filed on Aug. 25, 2022, and titled Replacement Tappet Assembly and Kit. The content of this application is incorporated herein by reference.

FIELD OF THE INVENTION

The present invention relates to a replacement tappet assembly and kit containing the same.

SUMMARY OF THE INVENTION

With the above in mind, embodiments of the present invention are related to an anti-rotation bracket for an internal combustion engine, comprising a peripheral wall having formed therein, four outer bolt apertures formed proximate to four corners of the bracket, and a groove formed in a lower surface of the bracket, the groove forming a contiguous depression around the lower surface of the bracket and passing between each outer bolt aperture and a center of the bracket. The bracket may further comprise two tappet structures comprising tappet apertures, the tappet structures being centered inward from the peripheral wall and an inner aperture positioned inward from the peripheral wall.

In some embodiments, the two tappet structures may extend upward relative to an upper surface of the peripheral wall. In some embodiments, a first tappet structure of the two tappet structures may be defined by a first wall section of which a first proportion is discrete from the peripheral wall, a second tappet structure of the two tappet structures may be defined by a second wall section of which a second proportion is discrete from the peripheral wall, and the first proportion may be greater than the second proportion.

In some embodiments, the inner aperture may be positioned in an area intermediate the two tappet structures and the peripheral wall. In some embodiments, the tappet apertures may comprise two opposing curved sections and two opposing flat sections.

Other embodiments of the invention may be directed to a kit for retrofitting tappet cover assemblies for an internal combustion vehicle, comprising two anti-rotation brackets, each anti-rotation bracket comprising a peripheral wall having formed therein four bolt apertures formed proximate to four corners of the bracket, and a groove formed in a lower surface of the bracket, the groove forming a contiguous depression around the lower surface of the bracket and passing between each bolt aperture and a center of the bracket, two tappet structures comprising tappet apertures, the tappet structures being centered inward from the peripheral wall, and an inner aperture positioned inward from the peripheral wall. The kit may further comprise two tappet covers, each tappet cover comprising four bolt apertures, each bolt aperture being formed proximate to a corner of the cover and positioned to cooperate with the four bolt apertures of the anti-rotation brackets, and two tappet cover apertures positioned to cooperate with the tappet structures of the anti-rotation bracket. The kit may further comprise two gaskets configured to be positioned intermediate the anti-rotation brackets and the tappet covers and two O-rings configured to be positioned at least partially within the grooves of the anti-rotation brackets.

BRIEF DESCRIPTION OF THE DRAWINGS

Some embodiments of the present invention are illustrated as an example and are not limited by the figures of the accompanying drawings, in which like references may indicate similar elements.

DETAILED DESCRIPTION OF THE INVENTION

Figure 1:
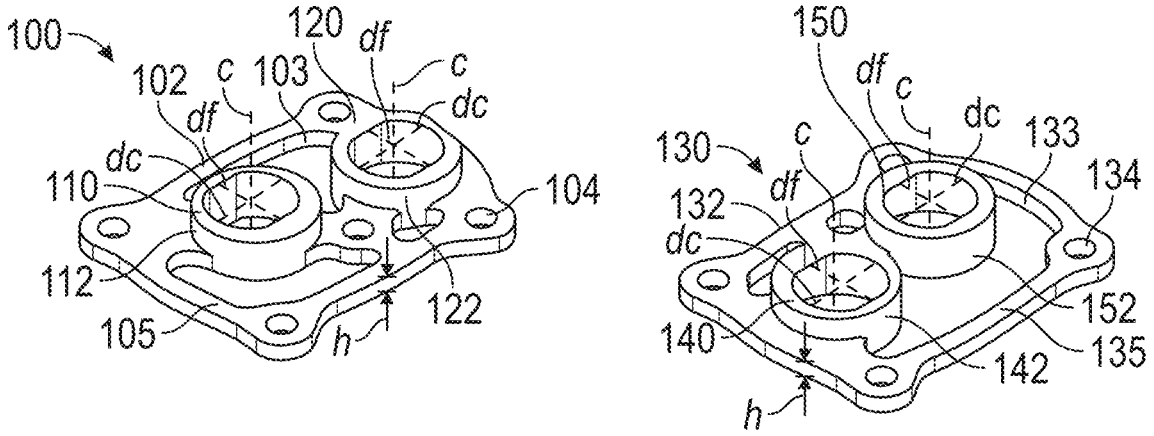
FIG. 1 is a perspective view of two replacement anti-rotation brackets according to an embodiment of the invention.
Figure 2:
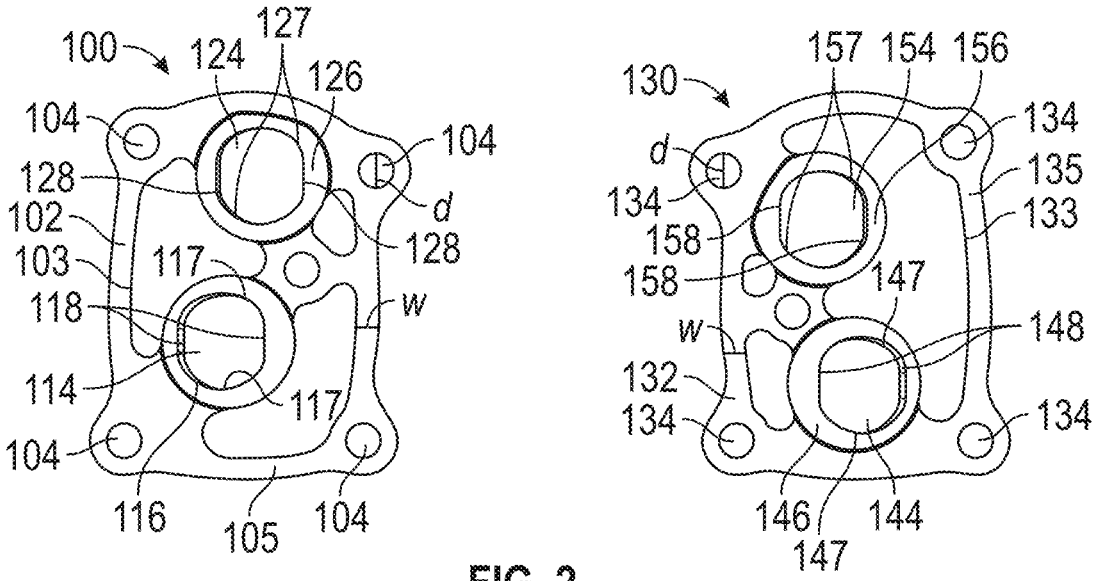
FIG. 2 is a top view of the replacement tanti-rotation brackets of FIG. 1.
Figure 3:
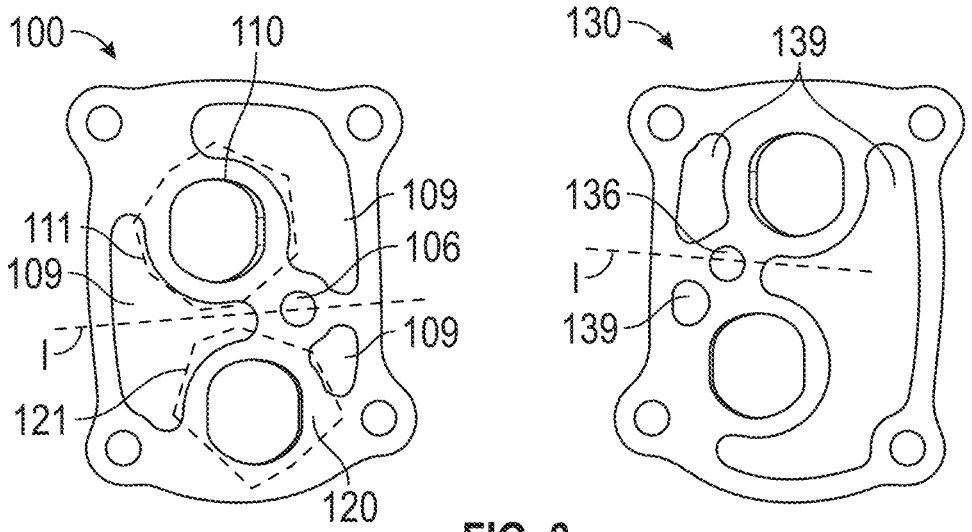
FIG. 3 is a bottom view of the replacement tanti-rotation brackets of FIG. 1.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

An embodiment of the invention, as shown and described by the various figures and accompanying text, provides a replacement tappet assembly and a kit for the same.

FIGS. 1-4 depict replacement anti-rotation brackets 100, 130 according to an embodiment of the invention. The brackets 100, 130 may be configured to replace anti-rotation brackets that are previously installed on an internal combustion engine of a motor vehicle. In some embodiments, the engine may be a motorcycle engine. The brackets 100, 130 may be formed as a single integral piece, with all features being formed either during initial forming of the bracket 100, 130, using any known formation or additive manufacturing techniques as are known in the art, or formed after initial creation of the bracket 100 130, using any known subtractive manufacturing technique as is known in the art. In other embodiments, one or more features, portions, or sections of the brackets 100, 130 may be formed separately and joined by any means or method as is known in the art, including, but not limited to, welding, fasteners, and the like.

The brackets 100, 130 may be configured to be installed at different places on the engine. In the present embodiment, they may be formed to attach to front and rear sections of the engine. Such different configurations may take the form of the brackets 100, 130 having slightly different geometries.

The brackets 100, 130 may each comprise a peripheral wall 102, 132. The peripheral wall 102, 132 may generally define the outer edge of the brackets 100, 130. In the present embodiment, the peripheral wall 102, 132 has a minimum width w of 0.2" and a minimum height h of 0.2". The peripheral wall 102, 132 may have formed therein four outer apertures 104, 134. Each outer aperture 104, 134 may be positioned at an approximate corner of the peripheral wall 102, 132. The outer apertures 104, 134 may be configured to permit a fastener therethrough. The fastener may be attached to a structure of the engine to attach the bracket 100, 130 to the engine. Such fasteners include, but are not limited to, bolts. The outer apertures 104, 134 may have a diameter d of 0.3".

The brackets 100, 130 may each further comprise two tappet structures 110, 120, 140, 150. The tappet structures 110, 120, 140, 150 may have centers c that is positioned inward from the peripheral wall 102, 132. "Inward" may be understood as within a boundary defined by an inner surface 103, 133 of the peripheral wall 102, 132.

Each tappet structure 110, 120, 140, 150 may comprise a vertical wall section 112, 122, 142, 152 extending upward relative to an upper surface 105, 135 of the peripheral wall 102, 132. The vertical wall section 112, 122, 142, 152 may extend 0.3" upward relative to the upper surface 105, 135 Additionally, each tappet structure 110, 120, 140, 150 may comprise a tappet aperture 114, 124, 144, 154. The tappet aperture 114, 124, 144, 154 may extend from a lower surface of the bracket 100, 130 through the vertical wall section 112, 122, 142, 152 and form an opening in an upper surface 116, 126, 146, 156 of the tappet structure 110, 120, 140, 150. The tappet structures 110, 120, 140, 150 may comprise pairs of opposing curved sections 117, 127, 147, 157 of an inner wall and pairs of opposing flat sections 118, 128, 148, 158 of the inner wall. The opposing curved sections 117, 127, 147, 157 may define a diameter dc of 1.0" and the opposing flat sections 118, 128, 148, 158 may define a diameter df of 0.8".

The brackets 100, 130 may each further comprise an inner aperture 106, 136. The inner apertures 106, 136 may be positioned inward from the peripheral wall. Additionally the inner apertures 106, 136 may be centered along a line/that runs between the tappet structures 110, 120, 140, 150. This may also be described as in an area intermediate the tappet structures 110, 120, 140, 150 and the peripheral wall 102, 132. The inner apertures 106, 136 may have a diameter of 0.3".

As shown for bracket 100, the first tappet structure 110 is defined by a first wall section 111. A first proportion of the first wall section 111 may be discrete from the peripheral wall 102. The second tappet structure 120 may be defined by a second wall section 121, a second proportion of which may be discrete from the peripheral wall. The first proportion may be greater than the second proportion.

The brackets 100, 130 may further comprise a plurality of interstitial spaces 109, 139 where there is a void of material between the peripheral wall 102, 132 and one or more of the tappet structures 110, 120, 140, 150 and the inner aperture 106, 136. The interstitial spaces 109 may be irregular in shape and be left as a void to reduce the material usage and weight of the bracket 100, 130.

Figure 4:
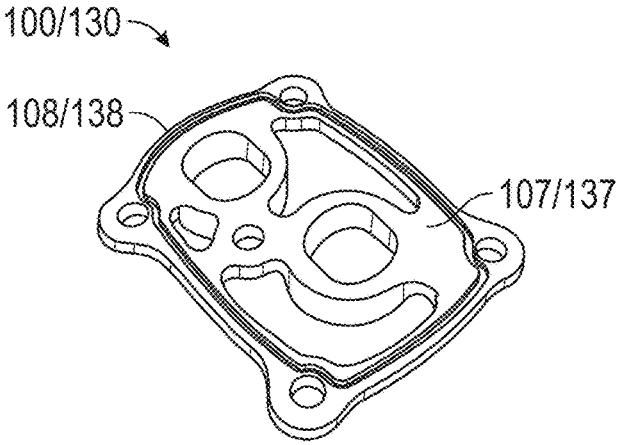
FIG. 4 is a lower perspective view of a replacement anti-rotation bracket of FIG. 1 showing a groove formed in the lower surface.

As shown in FIG. 4, a bracket 100/130 according to an embodiment of the invention may comprise a groove 108/138 formed in the lower surface 107/137 of the bracket 100/130. The groove 108/138 may form a contiguous depression around the lower surface 107/137 and be configured to permit an O-ring or other gasket structure to be positioned at least partially there within. The groove 107/137 may be formed within the peripheral wall 102, 132, and may be inward from the outer apertures 104, 134.

Figure 5:
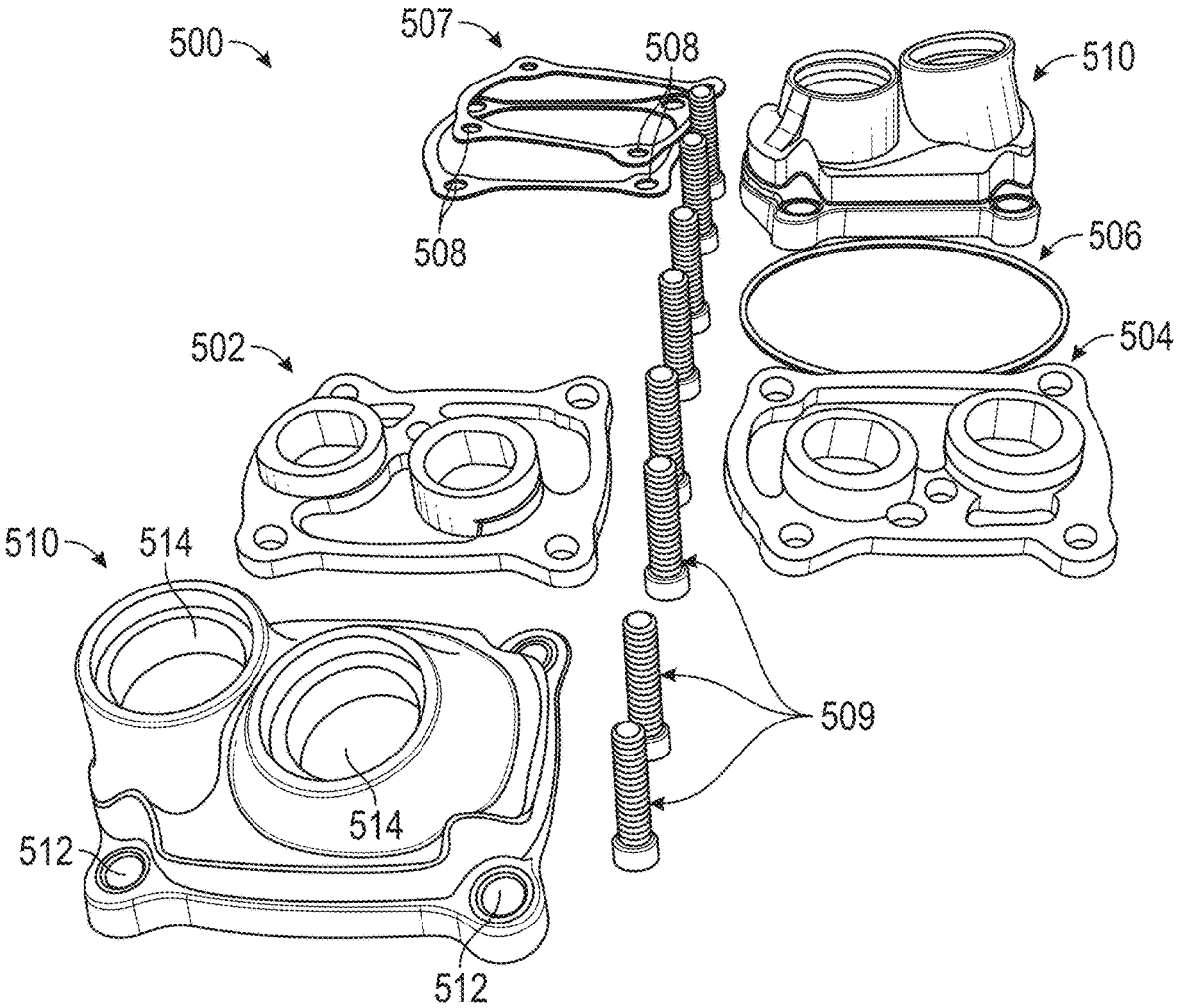
FIG. 5 is a perspective view of the components comprised by a kit according to an embodiment of the invention.

Referring now to FIG. 5, a kit 500 according to an embodiment of the invention is presented. The kit 500 may comprise first and second anti-rotation brackets 502, 504 like the brackets 100, 130 presented in FIGS. 1-4. The kit 500 may further comprise a plurality of O-rings 506 for positioning within a groove of the brackets 502, 504 as described above.

The kit 500 may further comprise two tappet covers 510. Each tappet cover 510 may be configured to overlie and cover a respective bracket 502, 504. Each tappet cover 510 may comprise four cover outer apertures 512 that are configured to cooperate with the outer apertures of the brackets 502, 504 and permit a fastener, such as a bolt, to pass therethrough. Similarly, the cover outer apertures 512 may be formed proximate to corners of the covers 510.

The tappet covers 510 may further comprise tappet cover apertures 514. The tapper cover apertures 514 may be positioned and configured to cooperate with the tappet structures of the brackets 502, 504. Accordingly, the tappet cover apertures 514 may comprise a matching pair of opposing flat sections and pair of opposing curved sections conforming to those of the tappet structures of the brackets 502, 504.

The kit 500 may further comprise a plurality of gaskets 507. The gaskets 507 may be configured to be positioned between the brackets 502, 504 and the tappet covers 510 and comprise apertures 508 configured to cooperate with the outer apertures of the brackets 502, 504 and the cover outer apertures 512 of the covers 510.

The kit 500 may further comprise a plurality of fasteners 509. In the present embodiment, the plurality of fasteners 509 comprises, and alternatively consists of, eight bolts. It is contemplated and included within the scope of the invention that any number of fasteners of any type as is known in the art may be comprised by or consist of the plurality of fasteners.

It is contemplated the kit 500 may consist of two brackets 502, 504, two covers 510, two O-rings 506, two gaskets 507, and eight bolts as shown in FIG. 5. It is further contemplated the kit may comprise two brackets 502, 504, two covers 510, two O-rings 506, two gaskets 507, and eight bolts.

Figure 6A:
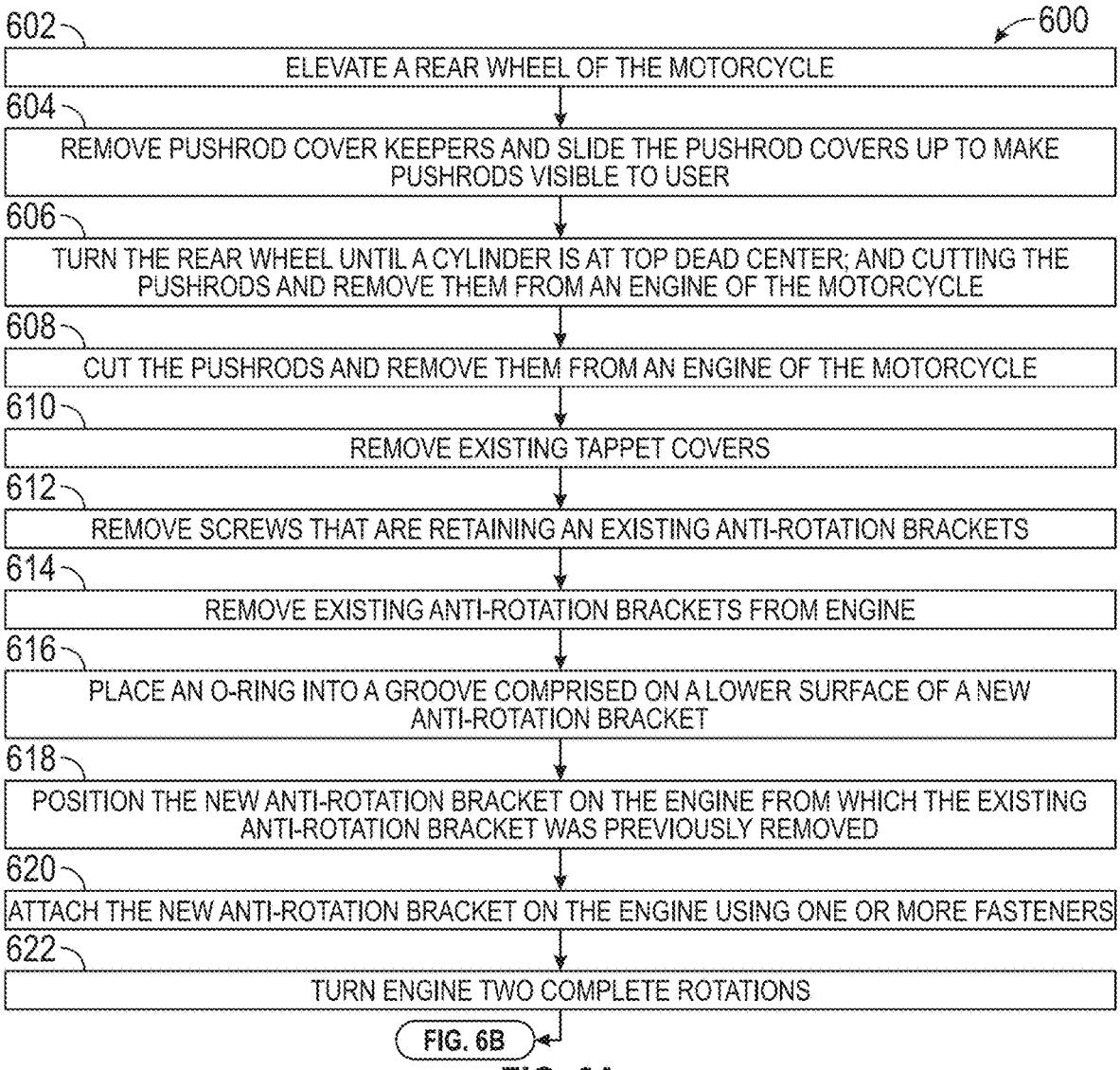
FIGS. 6A-B depict a method of installing a retrofit tappet assembly according to an embodiment of the invention.
Figure 6B:
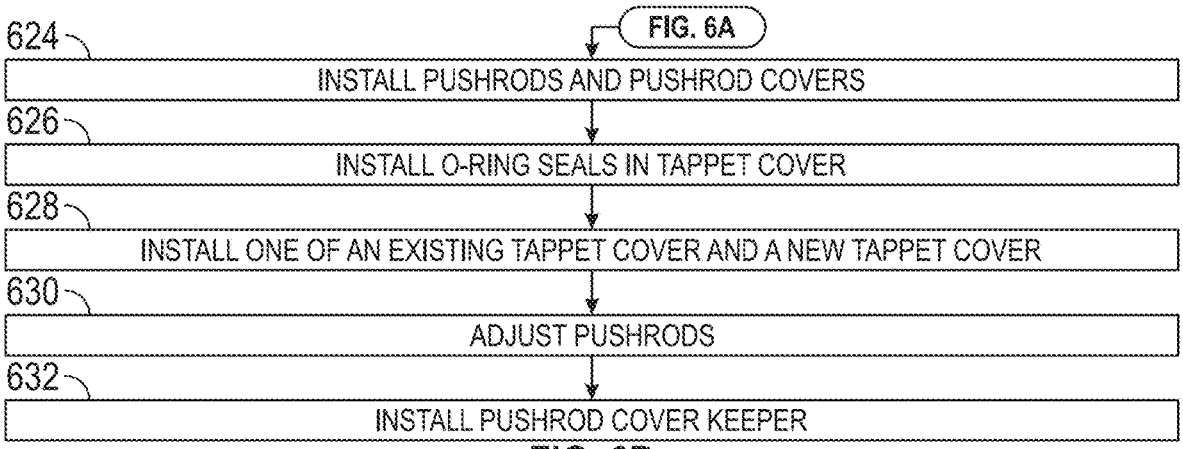

FIG. 6 is a flowchart of a method 600 of installing a replacement tappet assembly according to an embodiment of the invention. As shown in FIG. 6, method 600 may include elevating a rear wheel of the motorcycle (block 602). As also shown in FIG. 6, method 600 may include removing pushrod cover keepers and slide the pushrod covers up to make pushrods visible to user (block 604). The method 600 may further include, for each cylinder, turning the rear wheel until a cylinder is at top dead center (block 606) and cutting the pushrods and remove them from an engine of the motorcycle (block 608). The method 600 may continue with removing existing tappet covers (block 610). Method 600 may further include removing screws that are retaining an existing anti-rotation brackets (block 612) and removing existing anti-rotation brackets from engine (block 614). As further shown in FIG. 6, method 600 may include, for each of at least two new anti-rotation brackets, placing an O-ring into a groove may include on a lower surface of a new anti-rotation bracket (block 616), positioning the new anti-rotation bracket on the engine from which the existing anti-rotation bracket was previously removed (block 618), attaching the new anti-rotation bracket on the engine using one or more fasteners (block 620), and turning the engine two complete rotations (block 622). As also shown in FIG. 6, method 600 may further include installing pushrods and pushrod covers (block 624). As further shown in FIG. 6, method 600 may include, for each cylinder, installing O-ring seals in the tappet cover (block 626), installing one of an existing tappet cover and a new tappet cover (block 628), installing pushrod cover keeper (630), and adjusting the pushrods (block 632).

Although FIG. 6 shows example blocks of method 600, in some implementations, method 600 may include additional blocks, fewer blocks, different blocks, or differently arranged blocks than those depicted in FIG. 6. Additionally, or alternatively, two or more of the blocks of method 600 may be performed in parallel.

In some embodiments, the method 600 may further comprise installing feeler gauges after installing the new anti-rotation brackets and removing said feeler gauges after installing the one of the existing tappet cover and the new tapper cover. The feeler gauges may be of any appropriate dimension, including, but not limited to, 0.002".

In some embodiments, the method 600 may further comprise rotating the rear wheel until one of the cylinders is at top dead center after installing the pushrods and pushrod covers.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

What is claimed is:

1. An anti-rotation bracket for an internal combustion engine, the anti-rotation bracket comprising:
- a peripheral wall including:
  - four corners respectively defining four outer bolt apertures; and
  - a lower surface defining a groove formed as a contiguous depression passing between each outer bolt aperture and a center of the bracket;
- two tappet structures each defining a tappet aperture, the two tappet structures being centered inward from the peripheral wall; and
- an inner aperture positioned inward from the peripheral wall.

2. The anti-rotation bracket of claim 1 wherein the two tappet structures extend upward relative to an upper surface of the peripheral wall.

3. The anti-rotation bracket of claim 1 wherein:
- a first tappet structure of the two tappet structures is defined by a first wall section, portion of the first wall section being separated from the peripheral wall via at least one interstitial space;
- a second tappet structure of the two tappet structures is defined by a second wall section, a second portion of the second wall section being separated from the peripheral wall via the at least one interstitial space; and
- the first portion is greater than the second portion.

4. The anti-rotation bracket of claim 1 wherein the inner aperture is positioned in an area between the two tappet structures and away from the peripheral wall.

5. The anti-rotation bracket of claim 1 wherein each tappet aperture includes two opposing curved sections and two opposing flat sections.

6. A kit for retrofitting tappet cover assemblies of an internal combustion vehicle, the kit comprising:
- two anti-rotation brackets, each comprising:
  - a peripheral wall including:
    - four corners respectively defining four bolt apertures; and
    - a lower surface defining a groove formed as a contiguous depression passing between each bolt aperture and a center of the bracket;
  - an O-ring configured to be positioned at least partially within the groove;
  - two tappet structures each defining a tappet aperture, the two tappet structures being centered inward from the peripheral wall; and
  - an inner aperture positioned inward from the peripheral wall; and two tappet covers respectively associated with the two anti-rotation brackets, each tappet cover comprising:

four cover corners respectively defining four cover bolt apertures positioned so as to cooperate with the four bolt apertures of the associated anti-rotation bracket;

two tappet cover apertures positioned so as to respectively cooperate with the two tappet structures of the associated anti-rotation bracket; and a gasket configured to be positioned between the tappet cover and the associated anti-rotation bracket.

7. The kit of claim 6 wherein in each anti-rotation bracket, the two tappet structures extend upward relative to an upper surface of the peripheral wall.

8. The kit of claim 6 wherein in each anti-rotation bracket:

a first tappet structure of the two tappet structures is defined by a first wall section, a first portion of the first wall section being separated from the peripheral wall via at least one interstitial space;

a second tappet structure of the two tappet structures is defined by a second wall section, a second portion of the second wall section being separated from the peripheral wall via the at least one interstitial space; and the first portion is greater than the second portion.

9. The kit of claim 6 wherein in each anti-rotation bracket, the inner aperture is positioned in an area between the two tappet structures and away from the peripheral wall.

10. The kit of claim 6 wherein in each anti-rotation bracket, each tappet aperture comprises two opposing curved sections and two opposing flat sections.

11. The kit of claim 10 wherein in each tappet cover, the two tappet cover apertures are shaped to respectively conform to a shape of the tappet apertures of the associated anti-rotation bracket.

12. A method for installing a replacement tappet assembly of a motorcycle, the method comprising:

elevating a rear wheel of the motorcycle;

removing pushrod cover keepers;

sliding pushrod covers up so as to reveal pushrods of an engine of the motorcycle;

turning the rear wheel until a cylinder of the engine, associated with the pushrods, is at top dead center;

cutting the pushrods and removing them from the engine;

removing existing tappet covers;

removing screws which retain existing anti-rotation brackets;

removing the existing anti-rotation brackets from the engine;

placing an O-ring into a groove formed on a lower surface of each new anti-rotation bracket of a plurality of new anti-rotation brackets;

respectively placing each new anti-rotation bracket on the engine at positions from which the existing anti-rotation brackets were previously removed;

attaching each new anti-rotation bracket to the engine using one or more fasteners;

turning the engine two complete rotations;

installing new pushrods and new pushrod covers in the cylinder; and installing replacement tappet covers each including an O-ring seal, the replacement tappet covers being the existing tappet covers or new tappet covers;

adjusting the new pushrods; and installing the pushrod cover keepers.

13. The method of claim 12 further comprising:

installing feeler gauges after installing the new anti-rotation brackets; and removing the feeler gauges after installing the replacement tappet covers.

14. The method of claim 12 further comprising rotating the rear wheel until the cylinder is at top dead center after installing the new pushrods and the new pushrod covers.

* * * * *